US006349508B1

(12) United States Patent
Ju et al.

(10) Patent No.: US 6,349,508 B1
(45) Date of Patent: Feb. 26, 2002

(54) SMALL TYPE OF SEISMIC SHELTER CASE

(76) Inventors: Chien-Ping Ju; Jiin-Huey Chern Lin; Truan-Sheng Lui, all of No. 1, Ta Hsueh Road, Tainan (TW)

( * ) Notice: Subject to any disclaimer, the term of this patent is extended or adjusted under 35 U.S.C. 154(b) by 0 days.

(21) Appl. No.: 09/425,136

(22) Filed: Oct. 21, 1999

(51) Int. Cl.[7] ..... E04H 9/14
(52) U.S. Cl. ..... 52/79.1; 52/169.6
(58) Field of Search ..... 52/79.1, 79.14, 52/169.6, 265

(56) References Cited

U.S. PATENT DOCUMENTS 3,212,220 A * 10/1965 Boniecki et al. ..... 52/169.6 X
5,740,635 A * 4/1998 Gil et al. ..... 52/79.1
5,956,907 A * 9/1999 Martin ..... 52/169.6 X
5,979,128 A * 11/1999 Parsons ..... 52/79.1 X
6,085,475 A * 7/2000 Parks et al. ..... 52/79.1 X

FOREIGN PATENT DOCUMENTS

NL 51844 * 1/1942 ..... 52/169.6

* cited by examiner

*Primary Examiner*—Peter R. Brown
(74) *Attorney, Agent, or Firm*—Pro-Techtor International Services

(57) ABSTRACT

A small type of seismic shelter case, including an external layer of case of high strength, devised with a main entrance/exit opening and at least one secondary life escape exit, providing the space of containing human body inside; inside the case is fitted with a permeable inner layer of pad of strong seismic absorption and resistant to high temperature, and one safety belt to stabilize human body; and also devised with a storage box with various types of first aid item and rescue item; during occurrence of a strong earthquake, a shelter solicitor may enter the shelter case through the main entrance/exit and self stabilize by the safety belt. The said case can also prevent large rocks from directly falling inside, to reduce seismic hazard and extend the time of protecting the person inside it to wait for external rescue by upgrading the survival rate.

9 Claims, 6 Drawing Sheets

SMALL TYPE OF SEISMIC SHELTER CASE

BACKGROUND OF THE INVENTION

1. Field of the Invention

The present invention relates to a small type of seismic shelter case, and more particularly, to one with external case of high strength and toughness and soft inner pad, able to contain and protect human body to reduce the hazard of an earthquake, to wait inside the case for external rescue, to upgrade survival rate.

2. Description of the Prior Art

Whereas, since no rescue or shelter equipment is provided in general households, therefore, upon occurrence of a fierce earthquake, the public, due to failure of escape from residences, can only find a rather firm girder or column among the existing indoor equipment for hiding or find a large furniture (such as sofa, refrigerator, etc.) for shelter. However, as a real strong earthquake which even damage building structure to cause buildings decline, the above life escape methods normally are in vain. However, some rather lucky victims may survive by adopting the above life escape methods indeed, yet they still need to go through the lengthy waiting period for rescue, in a narrow, dark space, under the situation of no food and water, praying to be discovered earlier by rescuers and be saved. The ones who are saved out, even if with physical injury, are considered lucky in a disaster. If they are not rescued, as large machinery is applied for excavation later, they are likely to be injured or die out of it. In view of the various tragedies due to no device of shelter equipment, they certainly add sorrows to people.

In view of this, we inventors therefore proceed in the study and design of small type of seismic shelter case, and through continued modification, this invention is created finally.

SUMMARY OF THE INVENTION

The primary objective of the present invention is to provide a small type of seismic shelter case, with an external layer of case of high strength and a permeable inner layer of pad of strong seismic absorption and resistant to high temperature, providing the space of containing human body inside; in case of a strong earthquake to cause buildings collapse, its user may safely stay inside as a shelter, to reduce the seismic hazard and extend protection while waiting for rescue, to upgrade survival rate.

Figure 1:
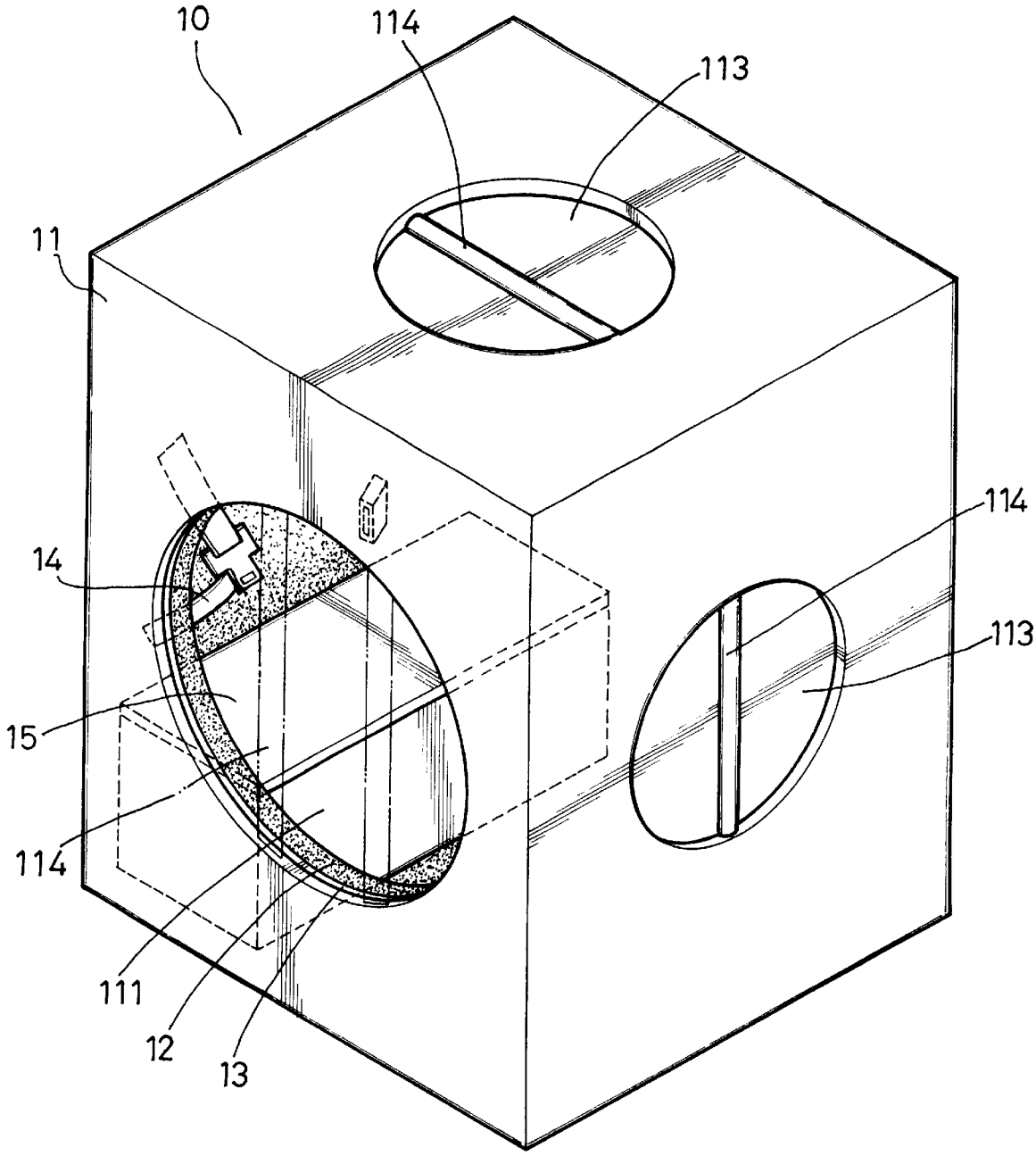
FIG. 1 is a schematic view showing the structure of the invention.
Figure 2:
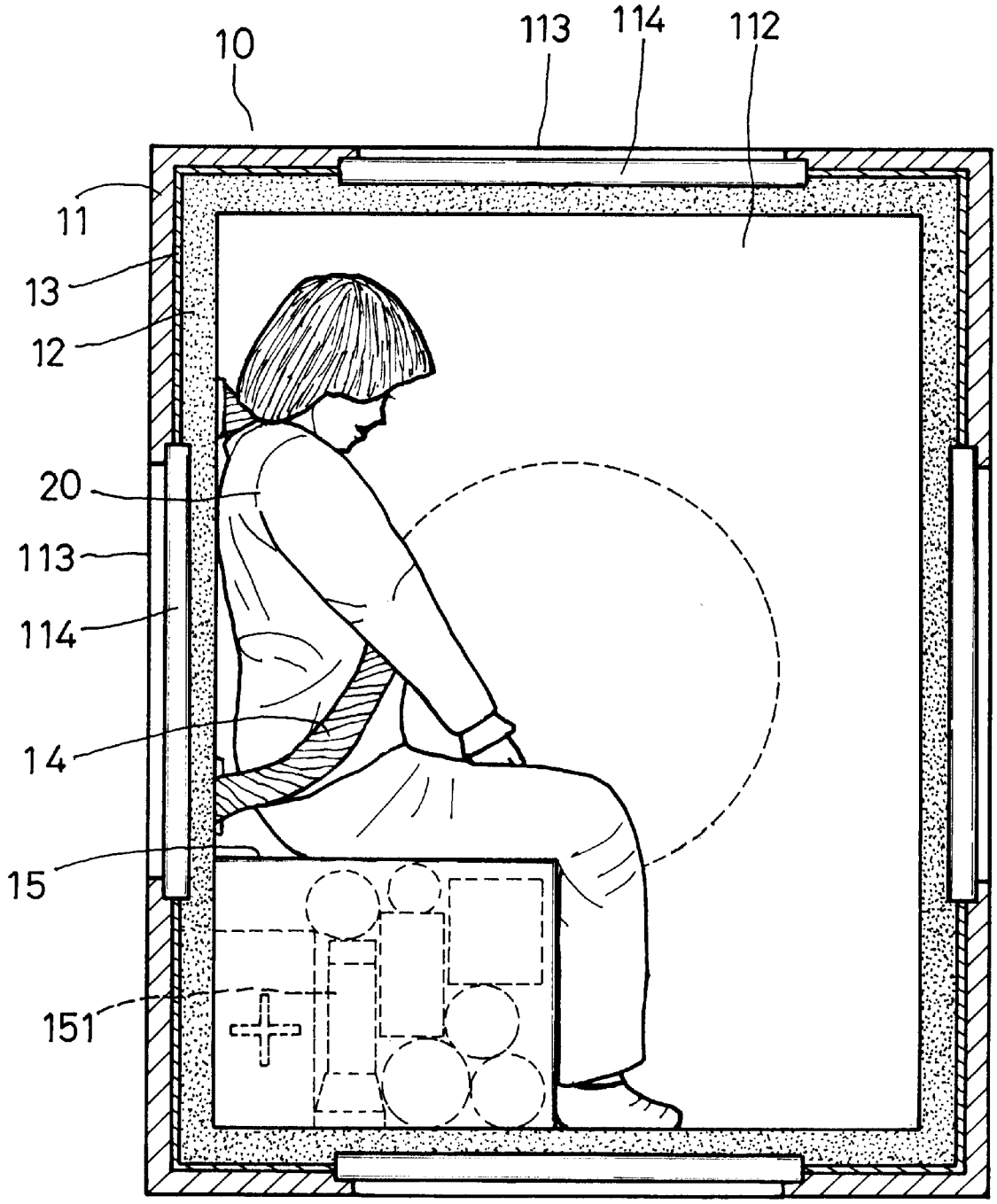
FIG. 2 is a sectional view of the service status of the invention.

DETAILED DESCRIPTION OF THE INVENTION:

Referring to FIGS. 1 and 2, the shelter case 10 of the invention is comprised of a case 11, made of metal material of high strength and toughness (such as cast iron, steel, stainless steel or titanium alloy), or compound of metal material and reinforced fiber material (such as glass fiber, carbon fiber or polymer fiber). In one facet of it, a main entrance/exit opening 111 is devised for human body to go in. Inside the case 11, a space 112 able to contain a human body is devised. In other facades, secondary life escape opening 113 is provided. At each secondary life escape opening 113, a removable metal rod unit of high strength 114 is devised.

One inner pad 12 is stabilized inside the case 11, made of permeable soft material with strong shock absorption and high temperature resistance, such as fire protection cotton of quartz material.

One safety belt 14 is devised inside the case 11 for tying human body. One storage box 15 is also devised inside the case 11, made of porous polymeric foam material. Inside the storage box 15, such rescue items 151 as drinking water, dry food, medical appliance, metal rod unit, radio, battery and small cutting tool, etc. are provided.

By means of the above device, the inner layer pad 12 and reinforced fiber textile 13 are fitted into the external case 11. Each secondary life escape opening 113 of each facade of case 11 is sealed with a removable metal rod unit 114, by leaving open only the main entrance/exit 111. FIG. 2 shows, in case of a strong earthquake, a shelter solicitor 20 may rapidly get into case 11 through the main entrance/exit 111, take metal rod 114 to insert to the main entrance/exit 111, rapidly sit over the storage box 15 and tie safety belt 14. If a strong earthquake causes a building to collapse, case 11 already generally protects the body of shelter solicitor 20 free from injury from direct hitting by collapsed rocks. Besides, the main entrance/exit 111 and each secondary life escape opening 113 may also block large rocks from falling into the metal case 11 by inserting metal rod unit 114. By that time, until the earthquake is over, if the shelter solicitor 20 inside has slight injury, the person may take the rescue item 151 from the storage box 15 to self wrap wound and wait till the external situation is stable, then remove the metal rod unit 114 from the main entrance/exit 111 to knock it and generate sharp sound as a help signal to outside party, waiting for rescue.

In another case, as a strong earthquake causes buildings to fall, the said shelter case 10 may also fall to roll over and block the main entrance/exit 111. At this time, the shelter solicitor 20 may use the small cutting tool inside storage box 15 to slice inner layer pad 12 and reinforced fiber textile 13, remove metal rod unit 114, to creep out the shelter case 10 through a secondary life escape opening 113.

Figure 3:
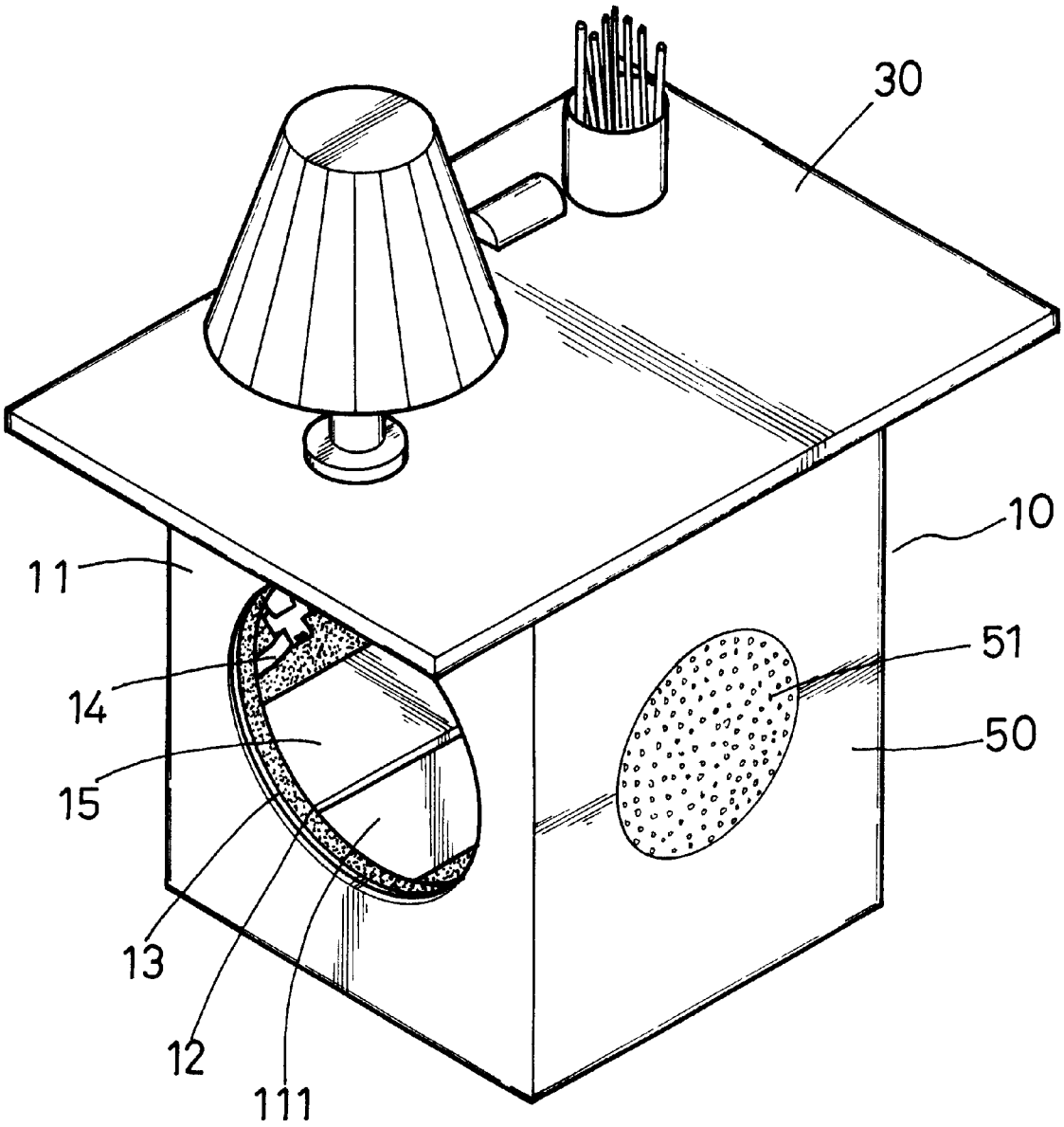
FIG. 3 is a schematic view, showing the first kind of practice of the invention.
Figure 4:
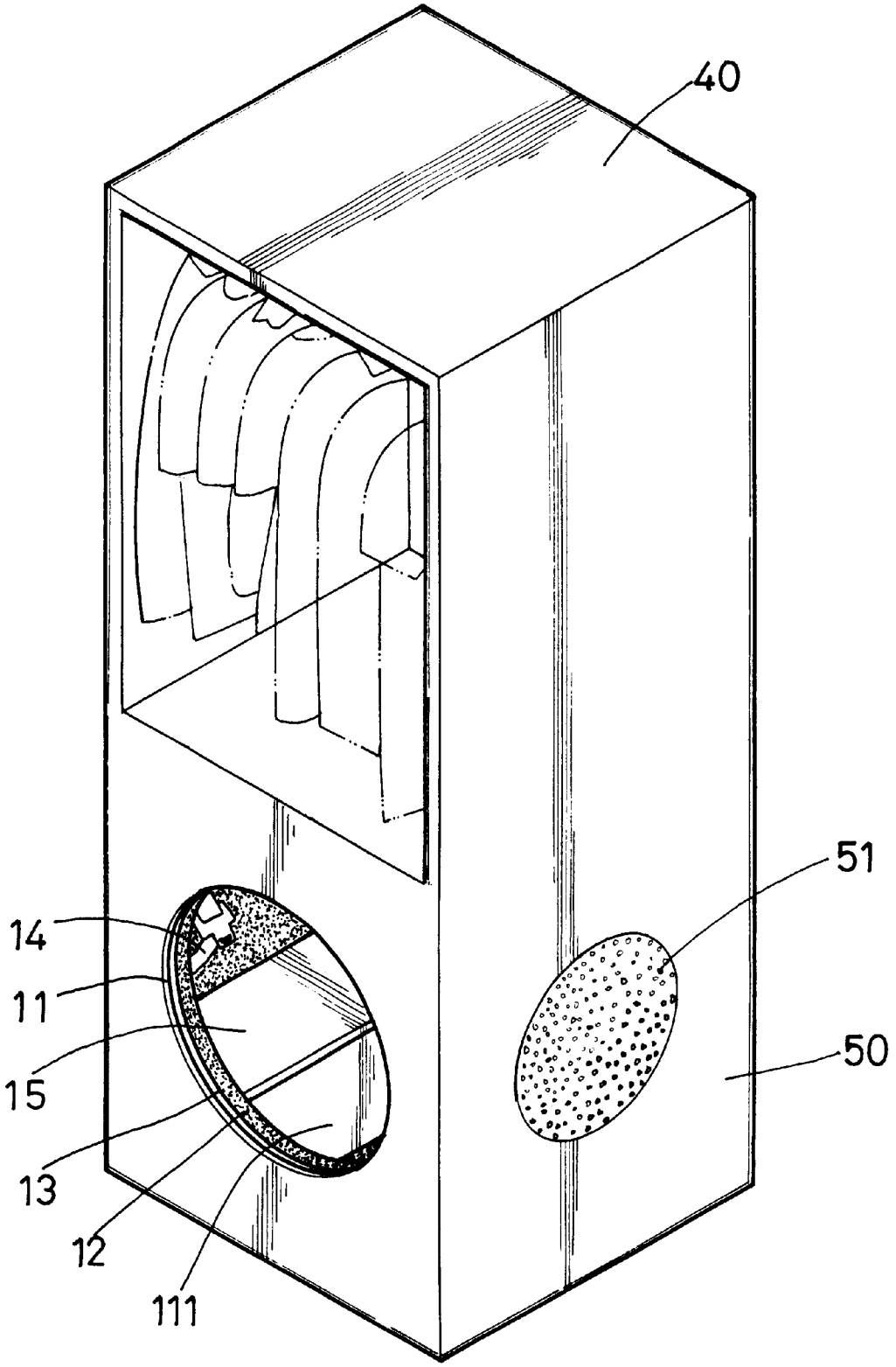
FIG. 4 is a schematic view showing the second kind of practice of the invention.

What stated above relate to the basic structure of the invention and its practical applications. As the shelter case 10 of the invention is laid at home or working place, in order to avoid its peculiarity, it may be combined with various furniture. FIG. 3 shows, as it is laid in a study, the invention may serve as a base of desk 30. FIG. 4 shows, as it is laid in a bedroom, the shelter case 10 can combine with closet 40. Besides, after it is combined with various furniture, wall paper or decorative cover 50 with permeable holes 51 can be fitted outside the metal case 11, to add outlook beauty. In this way, a shelter case 10 may be laid in each room to meet actual requirement, to facilitate each member to immediately get into the shelter case 10 upon encountering an earthquake as early as possible.

Figure 5:
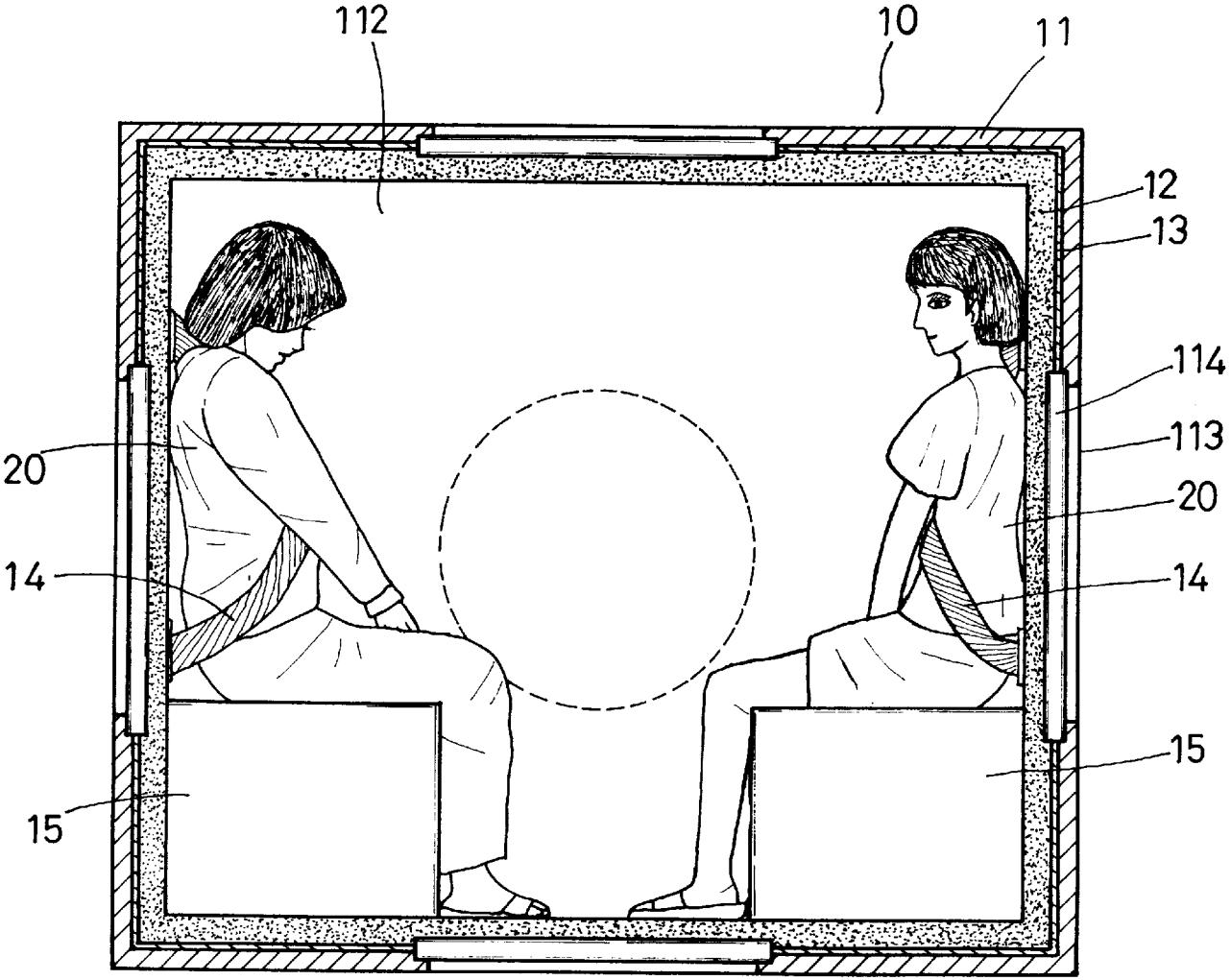
FIG. 5 is a schematic view showing the third kind of practice of the invention.
Figure 6:
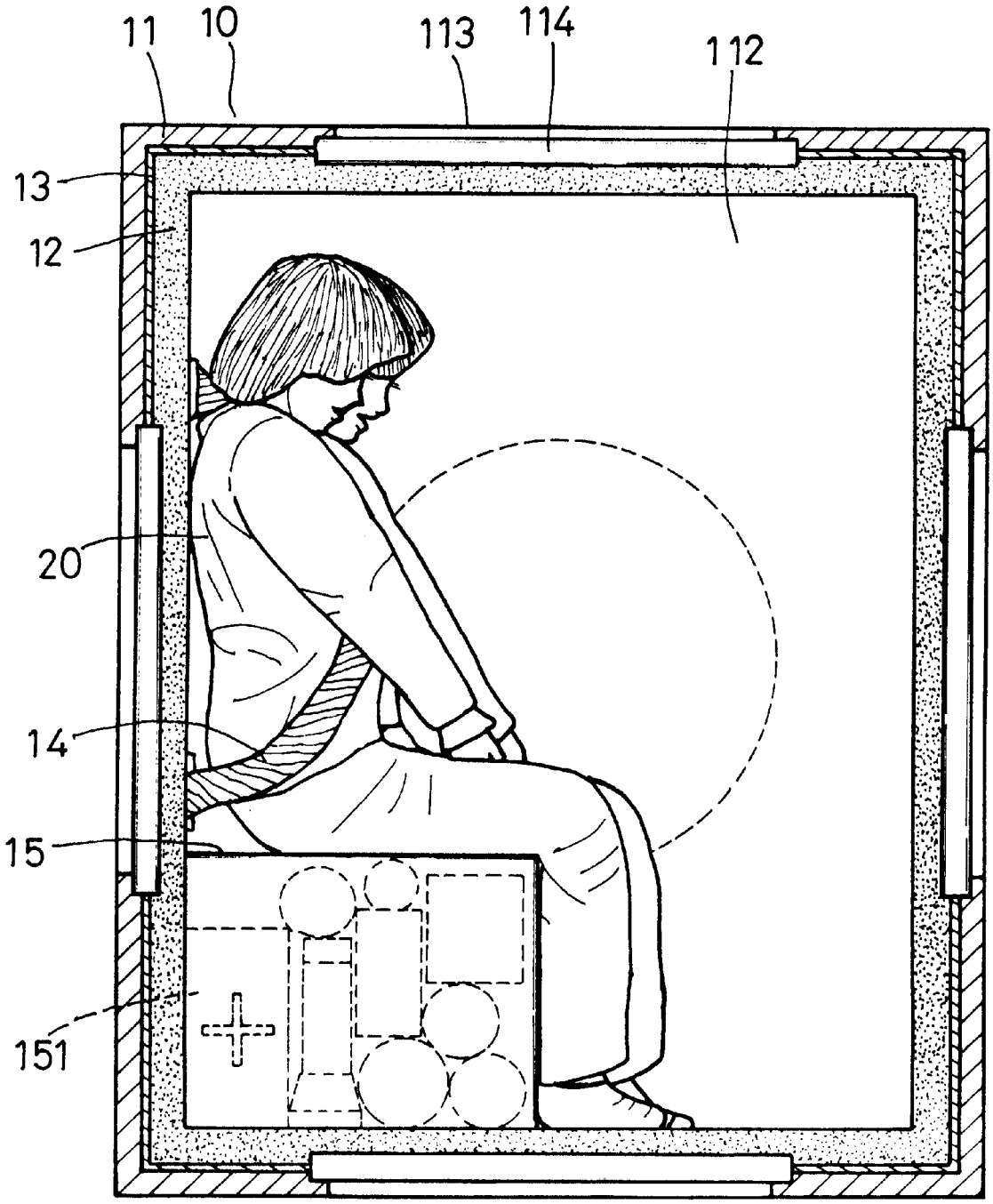
FIG. 6 is a schematic view showing the fourth kind of practice of the invention.

Besides the above mentioned single-person design, the invention can also be in two-people design which can be divided into opposite sitting manner as shown in FIG. 5 or parallel sitting manner as shown in FIG. 6. In structure, besides the required of widening or lengthening operation, there are no other changes.

The present invention allows the following advantages:

1. During a strong earthquake with falling and collapsing buildings, it may protect a shelter solicitor and reduce the hazard of injury in an earthquake. In addition, as large machinery is used for rapid excavation on striving for the top rescue time later, it may also avoid physical injury to a human body of a machinery.
2. The external layer is a case of high strength and toughness, not easily deformed or fractured. The inner layer is soft pad and safety belt it also provided, able to reduce the probability of injury to a shelter solicitor inside.
3. A storage box is provided inside, able to supply drink, food, and medical appliance. Besides, through the knocking of a metal rod, it can help the outside party to discover the person as early as possible for rescue, and upgrade the survival rate.
4. It can be combined with furniture. Besides effective use of space, it also facilitates timely application.

What is claimed is:

1. A seismic shelter comprising:

a case of sufficient size to receive a human body therein, said case includes a main entrance/exit for said human body to enter and exit said shelter, said main entrance/exit being generally circular and being unencumbered by a door or other blocking means that would inhibit entry into said case, said case comprises an inner cushion layer made of soft material with strong shock absorption and high temperature resistance, and a safety belt installed in an interior of said case, said safety belt being used to stabilize said human body.

2. The seismic shelter as claimed in claim 1 wherein:

at least one secondary escape opening is included in said case.

3. The seismic shelter as claimed in claim 2 wherein:

said at least one secondary escape opening includes a removable metal rod unit, said rod unit serving to block said at least one secondary escape opening when said rod unit is installed therein.

4. The seismic shelter as claimed in claim 1 wherein:

said main entrance/exit includes a removable metal rod unit, said rod unit serving to block said main entrance/exit when said rod unit is installed therein.

5. The seismic shelter as claimed in claim 1 wherein:

a layer of reinforced fiber textile with high strength and insulation values is included between said case and said inner cushion layer.

6. The seismic shelter as claimed in claim 1 wherein:

a storage box is included in said interior of said case, said storage box including a surface suitable to be used as a seat.

7. The seismic shelter as claimed in claim 1 wherein:

said case is utilized in combination with furniture.

8. The seismic shelter as claimed in claim 1 wherein:

said case is made from metal.

9. The seismic shelter as claimed in claim 1 wherein:

said case is made from metal and reinforced fiber.

* * * * *